US010626737B2

(12) United States Patent
Ju et al.

(10) Patent No.: US 10,626,737 B2
(45) **Date of Patent: *Apr. 21, 2020**

(54) ROTATING BODY, METHOD OF MANUFACTURING THE SAME, AND STEAM TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventors: Jae Min Ju, Changwon-si (KR); Seok Jin Jang, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 116 days.

This patent is subject to a terminal disclaimer.

(21) Appl. No.: 15/953,524

(22) Filed: Apr. 16, 2018

(65) Prior Publication Data

US 2018/0313217 A1 Nov. 1, 2018

(30) Foreign Application Priority Data

Apr. 28, 2017 (KR) ..... 10-2017-0055422

(51) Int. Cl.
*F01D 5/32* (2006.01)
*F01D 5/30* (2006.01)

(52) U.S. Cl.
CPC ..... *F01D 5/3046* (2013.01); *F01D 5/32* (2013.01); *F05D 2220/31* (2013.01);
(Continued)

(58) Field of Classification Search
CPC ..... F01D 5/3045; F01D 5/32; F05D 2230/60; F05D 2260/30
See application file for complete search history.

(56) References Cited

U.S. PATENT DOCUMENTS 2,199,243 A * 4/1940 Mortimer ..... F01D 5/225 416/217
6,499,959 B1 * 12/2002 Reluzco ..... F01D 5/3046 416/215

(Continued)

FOREIGN PATENT DOCUMENTS

JP 6361702 A 3/1988

OTHER PUBLICATIONS

An European Search Report dated Sep. 20, 2018 in connection with European Patent Application No. 18169438.1 which corresponds to the above-referenced U.S. application.

*Primary Examiner* — Ninh H. Nguyen
(74) *Attorney, Agent, or Firm* — Invenstone Patent, LLC

(57) ABSTRACT

A rotatable body includes a rotor and n buckets, each bucket being coupled to the rotor in a tangential entry manner. The rotor supports each of the n buckets coupled to the rotor, so the buckets may be stably coupled to the rotor, using a unified annular dovetail tenon that protrudes axially from the rotor. Each bucket includes a bucket dovetail mortise for engaging with the unified annular dovetail tenon in order to couple the bucket to the rotor. A method of manufacturing the rotatable body includes assembling first to (n−1)th buckets with the rotor wheel by successively inserting the first to (n−1)th buckets through the tangential entry; assembling the nth bucket with the adapter; assembling the adapter with the rotor wheel, by inserting the adapter assembled with the nth bucket into the tangential entry; and collectively moving all the buckets by one half pitch in the circumferential direction.

20 Claims, 9 Drawing Sheets

(52) U.S. Cl.
CPC .... *F05D 2230/60* (2013.01); *F05D 2240/128* (2013.01); *F05D 2240/14* (2013.01); *F05D 2240/24* (2013.01); *F05D 2260/30* (2013.01)

(56) References Cited

U.S. PATENT DOCUMENTS

| | | | | |
|---|---|---|---|---|
| 7,261,518 | B2 * | 8/2007 | Golinkin | F01D 5/3007 416/215 |
| 8,894,372 | B2 * | 11/2014 | Willett, Jr. | F01D 5/32 416/220 R |
| 2006/0216152 | A1 | 9/2006 | Golinkin et al. | |
| 2011/0008171 | A1 | 1/2011 | Tsumura et al. | |
| 2012/0099999 | A1 | 4/2012 | Bhokardole et al. | |

* cited by examiner

【FIG 1】
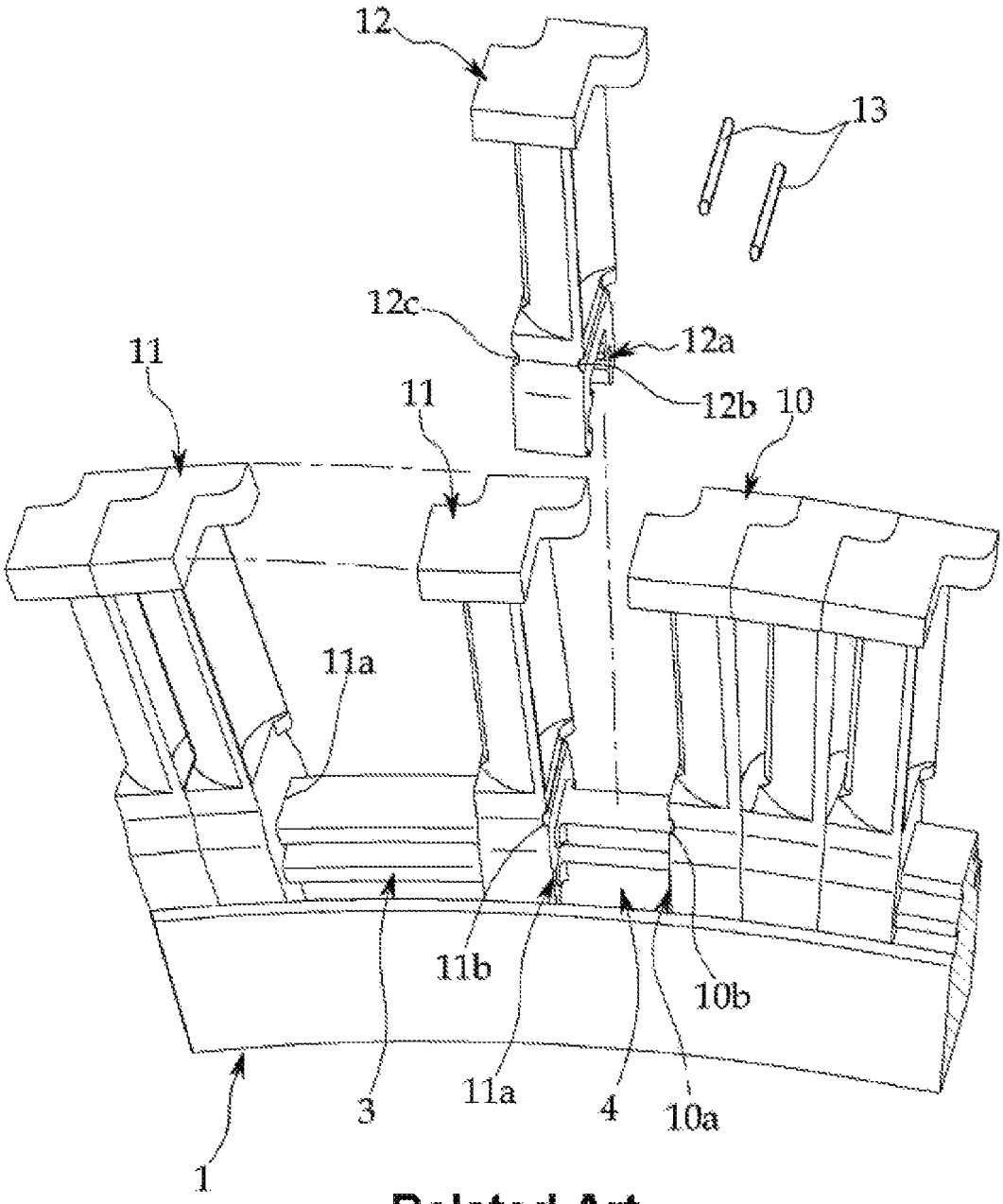
Related Art

【FIG 2】
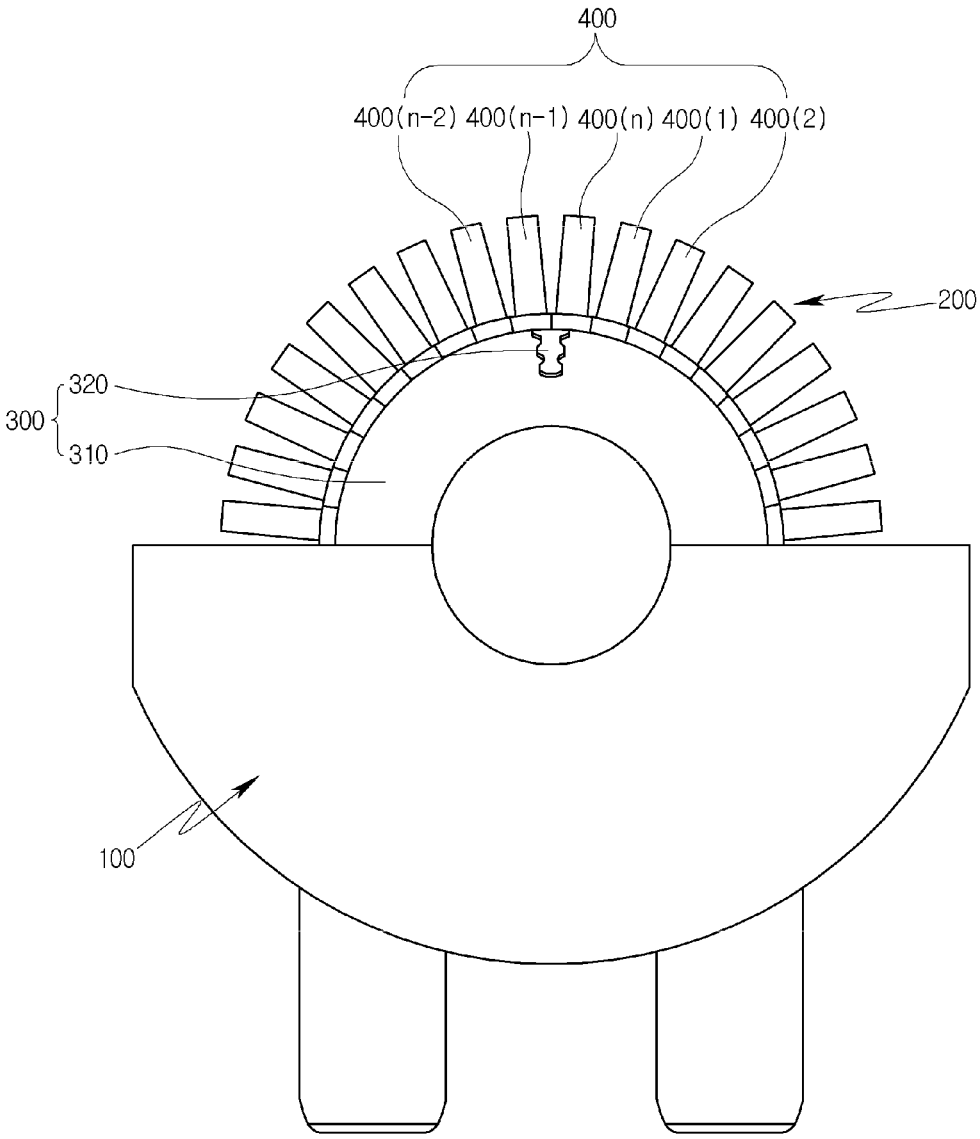

【FIG 3】
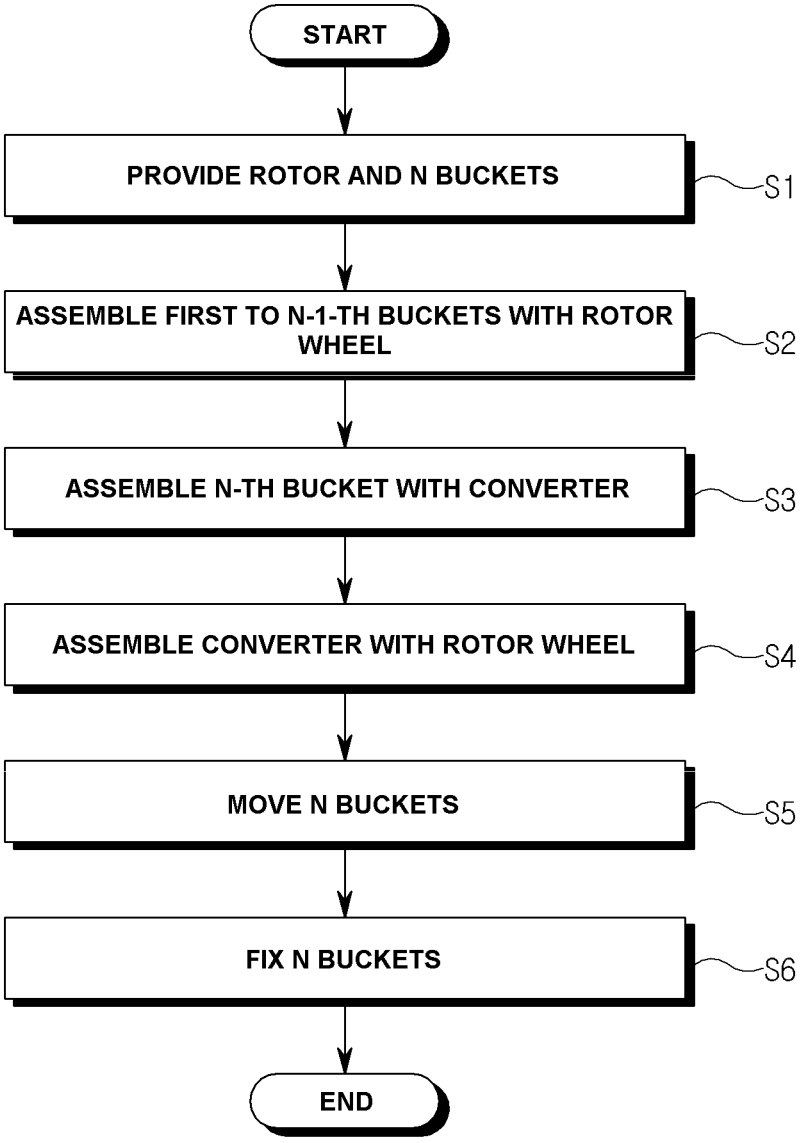

【FIG 4】
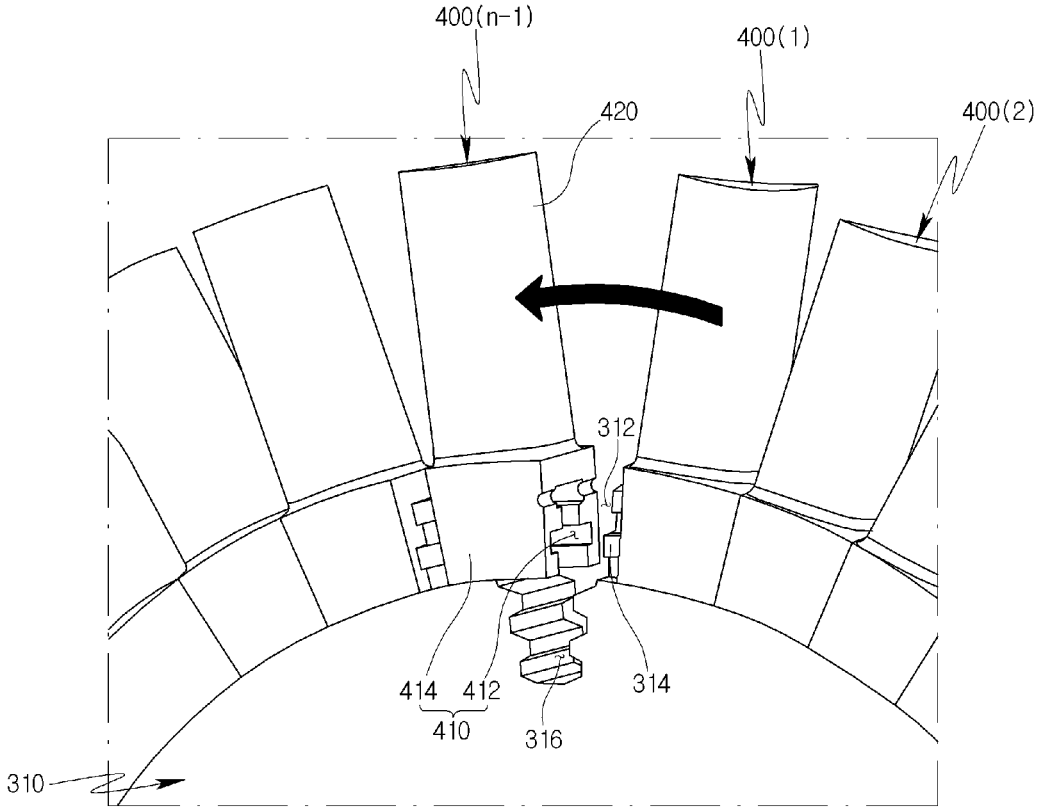

【FIG 5】
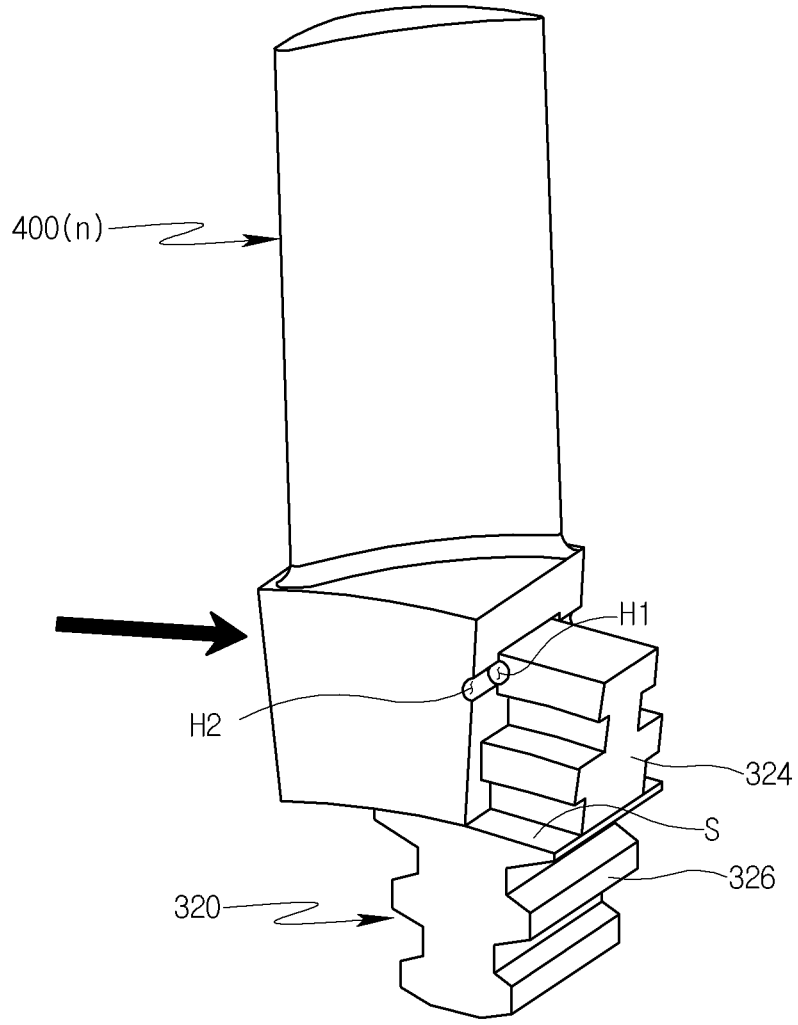

【FIG 6】
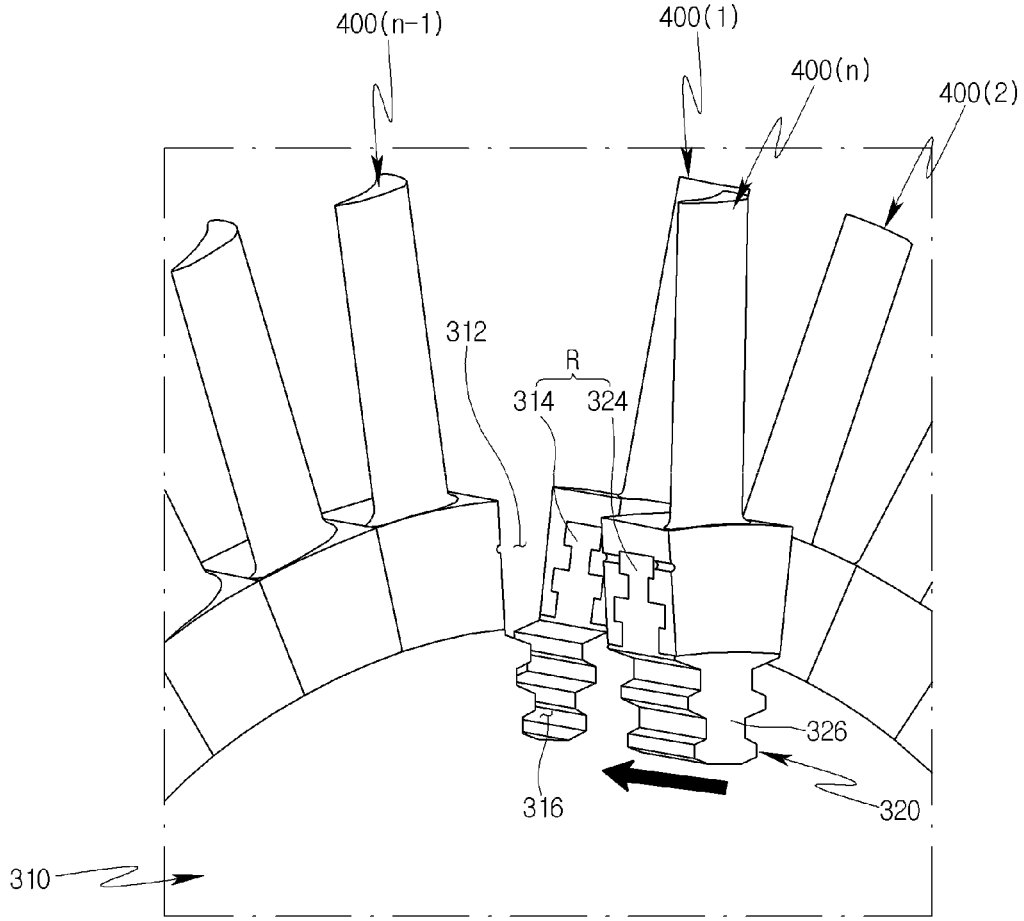

【FIG 7】
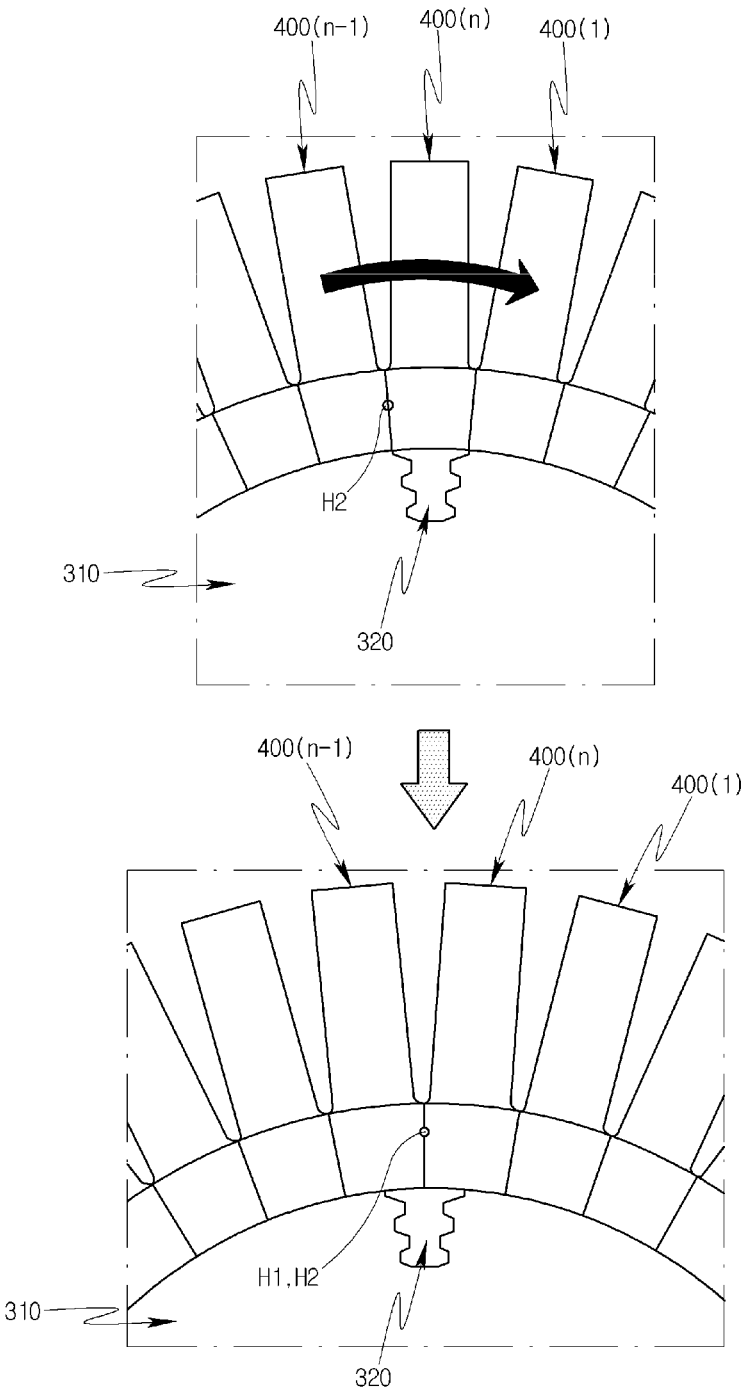

【FIG 8】
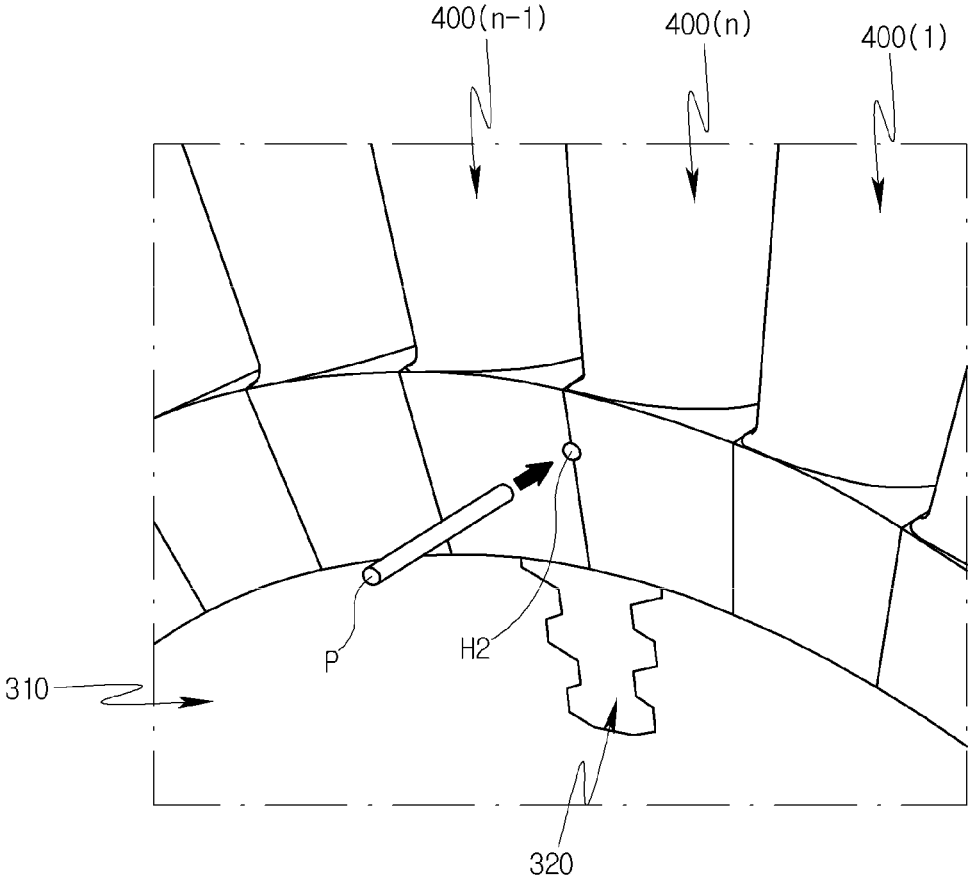

【FIG 9】
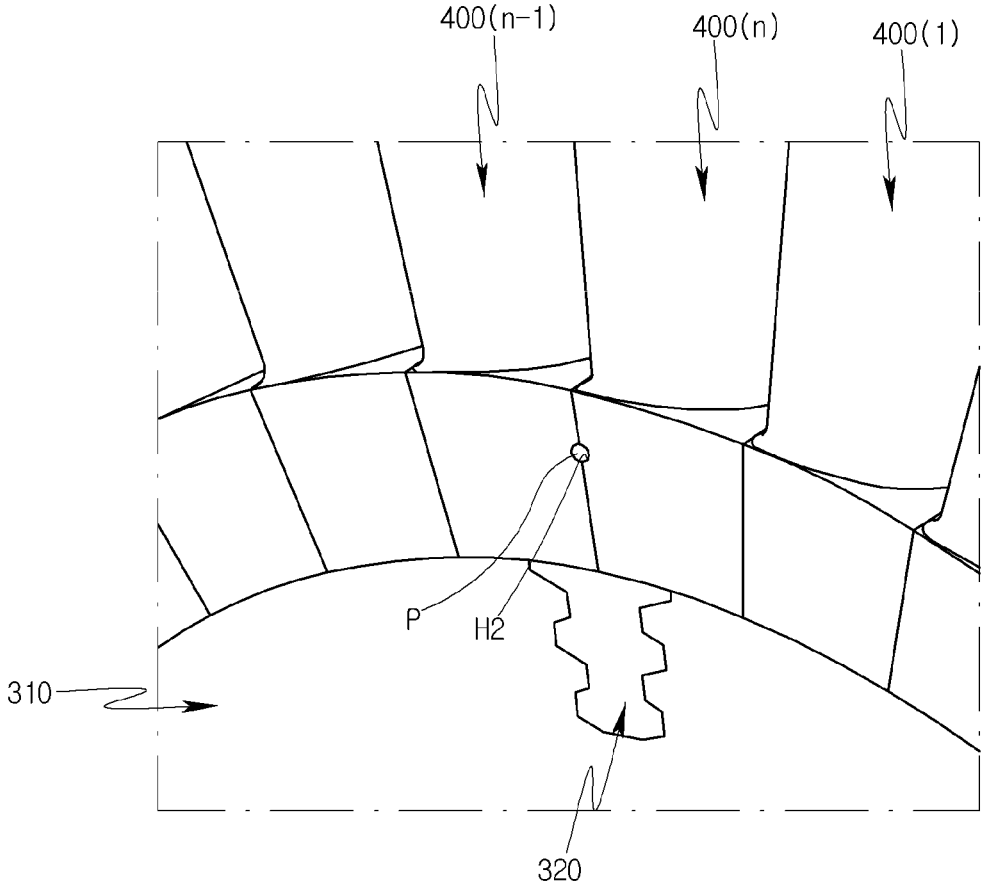

ROTATING BODY, METHOD OF MANUFACTURING THE SAME, AND STEAM TURBINE INCLUDING THE SAME

CROSS-REFERENCE TO RELATED APPLICATIONS

This application claims priority to Korean Patent Application No(s). 10-2017-0055422, filed on Apr. 28, 2017, the disclosure(s) of which is (are) incorporated herein by reference in its (their) entirety.

BACKGROUND OF THE INVENTION

Field of the Invention

Exemplary embodiments of the present invention relate to a rotatable body, a method of manufacturing the rotatable body, and a steam turbine including the rotatable body, and more particularly, to a rotatable body configured to enable buckets to be stably coupled to the rotor in a tangential entry manner, a method of manufacturing the rotatable body, and a steam turbine including the rotatable body.

Description of the Related Art

Generally, a turbine is a machine which converts the energy of fluid such as water, gas, or steam into mechanical work. Typically, a turbo machine, in which a plurality of blades are fitted around a circumferential portion of a rotatable body so that the rotatable body is rotated at a high speed by discharging steam or gas toward the blades, is referred to as a turbine.

Such turbines may be classified into, among others, a water turbine using the energy of elevated water; a steam turbine using the energy of flowing steam; a gas turbine using the energy of high-temperature, high-pressure gas; and an air turbine using the energy of high-pressure, compressed air. Among these, a steam turbine is configured to convert steam energy into mechanical work by rotating a rotatable body using steam projected onto blades from a nozzle. Such a steam turbine includes a casing which forms an outer appearance and frame of the turbine, the rotatable body rotatably installed in the casing, and the nozzle configured to discharge steam toward the rotatable body.

Korean Patent No. 10-1376716 discloses a rotating part and a steam turbine including the same, in which a related art rotatable body includes a rotor and a plurality of buckets coupled to the rotor and configured to convert the energy of flowing steam discharged from a nozzle (not shown) into mechanical work. Here, a number (n) of buckets are coupled to a rotor in a so-called tangential entry manner, in which each bucket is installed by inserting it into a tangential entry and then sliding the inserted bucket in a circumferential direction of the rotor.

Referring to FIG. 1, a rotor 1 has the basic shape of a flat, circular plate, i.e., a disc. A tangential entry 4 providing passage for installing n buckets 10, 11, 12 is formed at a predetermined position in a circumferential portion of the rotor 1. A rotor dovetail tenon 3 for supporting the installed buckets 10 and 11 is provided on the circumferential portion of the rotor 1 and extends along a circumferential surface of the rotor 1, between opposite sides of the tangential entry 4, leaving a gap corresponding to the predetermined position of the tangential entry 4.

On the one hand, each of the n buckets 10, 11, 12 includes a root having a bucket dovetail mortise 10*a*, 11*a*, 12*a* capable of engaging with the rotor dovetail tenon 3, and a blade protruding from the root in the rotor's radial direction, whereby the first through (n−1)th buckets 10 through 11 are supported by the rotor dovetail tenon 3. On the other hand, the nth bucket 12 is supported by a pair of separately provided pins 13. That is, the nth bucket 12, which is a closer bucket that is last to be installed, is supported by a pair of separately provided pins 13, because the nth bucket 12 is merely inserted into the tangential entry 4.

In detail, a first groove 12*b* is formed in a first side surface of the root of the nth bucket 12, and a third groove 10*b* is formed in an opposing side surface of the root of the first bucket 10 that is adjacent to the nth bucket 12. The first and third grooves 12*b* and 10*b* are formed as recesses in the rotor's circumferential direction, and when combined, the opposing recesses form a first pin hole into which a first pin 13 is to be inserted. Meanwhile, a second groove 12*c* is formed in a second side surface of the root of the nth bucket 12, and a fourth groove 11*b* is formed in an opposing side surface of the root of the (n−1)th bucket 11 that is adjacent to the nth bucket 12. The second and fourth grooves 12*c* and 11*b* are, likewise, formed as recesses in the rotor's circumferential direction, and when combined, the opposing recesses a second pin hole into which a second pin 13 is to be inserted. In the foregoing configuration, one side of the nth bucket 12 is supported by the first bucket 10 through the first pin 13 inserted into the first pin hole, while the other side of the nth bucket 12 is supported by the (n−1)th bucket 11 through the second pin 13 inserted into the second pin hole.

The related art rotatable body having the above configuration is manufactured as follows.

The first through (n−1)th buckets 10 through 11 are successively coupled to the rotor 1 by individually inserting the first through (n−1)th buckets 10 through 11 into the tangential entry 4 and then sliding them in the rotor's circumferential direction along the rotor dovetail tenon 3 using the respective bucket dovetail mortises 10*a* through 11*a* of the buckets 10 through 11. Lastly, the nth bucket 12 is inserted into the tangential entry 4, and with the nth bucket 12 thus positioned, the first and second pins 13 are respectively inserted into the first and second pin holes.

However, in the above-described rotatable body and method of manufacturing the same according to the related art, the buckets are not stably coupled to the rotor. That is, because the nth bucket 12 is supported by the first (n−1)th buckets 10 and 11 rather than being supported by the rotor dovetail tenon 3, a significant amount of load is applied to each of a coupling portion between the first bucket 10 and the rotor 1 and a coupling portion between the (n−1)th bucket 11 and the rotor 1. These coupling portions may therefore be damaged by the applied load, such that the corresponding buckets may become unstably coupled, that is, loosened or separated from the rotor 1. A significant amount of load is also applied to the first pin 13, the first pin hole, the second pin 13, and the second pin hole, which may likewise be damaged, such that the associated buckets may similarly become unstably coupled to the rotor 1. In addition, the nth bucket 12 may become separated from the rotor 1 through an undesirable shifting in the rotor's axial direction. Furthermore, during operation of a steam turbine including a rotatable body according to the related art, the n buckets 10, 11, 12 may rotate relative to the rotor 1, that is, the buckets may collectively experience a shifting in the rotor's circumferential direction, in which case there is a reduction in efficiency.

SUMMARY OF THE INVENTION

An object of the present invention is to provide a rotatable body configured to enable a bucket to be stably coupled to a rotor, a method of manufacturing the rotatable body, and a steam turbine including the rotatable body.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a rotatable body may include a rotor; and n buckets for converting energy of flowing steam into mechanical work, each bucket configured to be coupled to the rotor in a tangential entry manner, wherein the rotor is configured to support each of the n buckets coupled to the rotor.

The rotatable body may further include a unified annular dovetail tenon protruding axially from a circumferential surface of the rotor, wherein each of the n buckets includes a bucket dovetail mortise for engaging with the unified annular dovetail tenon in order to couple the bucket to the rotor. Each of the n buckets may be configured to be inserted though the tangential entry and then slid in a circumferential direction of the rotor on the unified annular dovetail tenon in order to successively assemble the n buckets with the rotor.

The rotor may have a circumferential surface on which a tangential entry is provided, and a portion of a specific bucket of the n buckets and a portion of a bucket adjacent to the specific bucket may simultaneously overlap a circumferential length of the tangential entry.

The rotor may include an adapter for coupling an nth bucket of the n buckets to the rotor; and a rotor wheel having a circumferential surface on which a tangential entry is provided, wherein the adapter fills the tangential entry when the nth bucket is coupled to the rotor.

The adapter may be configured to be coupled to the rotor wheel by moving the adapter in an axial direction of the rotor.

The rotor wheel may include an axial dovetail mortise, extending in an axial direction of the rotor, configured to receive the adapter at the tangential entry.

The rotor wheel may include a rotor dovetail tenon extending in a circumferential direction of the rotor from one side of the tangential entry to the other side of the tangential entry, the rotor dovetail tenon having a gap at the tangential entry.

The adapter may include an adapter dovetail tenon configured to fill the gap in the rotor dovetail tenon when the nth bucket is coupled to the rotor. In order to successively assemble the n buckets with the rotor wheel, each of first to (n−1)th buckets of the n buckets may be configured to be inserted through the tangential entry and then slid in the circumferential direction of the rotor on the rotor dovetail tenon, an nth bucket of the n buckets may be configured to be assembled with the adapter by sliding on the adapter dovetail tenon, and the adapter assembled with the nth bucket may be configured to be inserted into the tangential entry in an axial direction of the rotor.

The rotor dovetail tenon and the adapter dovetail tenon may form a unified annular dovetail protrusion protruding axially from a circumferential surface of the rotor.

The adapter dovetail tenon may be configured to support at least one bucket of the n buckets.

First to (n−1)th buckets may be inserted through the tangential entry and then slid in the circumferential direction of the rotor on the rotor dovetail tenon in order to successively assemble the first to (n−1)th buckets with the rotor wheel. An nth bucket may be assembled with the adapter and the adapter assembled with the nth bucket is inserted into the tangential entry in an axial direction of the rotor in order to assemble the nth bucket with the rotor wheel. The first to (n−1)th buckets assembled with the rotor wheel and the nth bucket assembled with the adapter are collectively moved to a predetermined position along the circumferential direction of the rotor, so that the (n−1)th bucket axially and radially overlaps a first junction between the rotor dovetail tenon and the adapter dovetail tenon, and the nth bucket axially and radially overlaps a second junction between the rotor dovetail tenon and the adapter dovetail tenon.

When a length of a bucket of the n buckets with respect to the circumferential direction of the rotor is one pitch, the predetermined position may be a position to which the first to (n−1)th buckets assembled with the rotor wheel and the nth bucket assembled with the adapter are collectively moved by one half pitch along the circumferential direction of the rotor.

The rotatable body may further include a fixing unit configured to fix the first to nth buckets at the predetermined position. The fixing unit may include at least one bucket in which a second pin hole is formed to be aligned with a first pin hole formed in one of the rotor and adapter dovetail tenons when the first to nth buckets are disposed at the predetermined position; and a pin inserted into the first pin hole and the second pin hole. The first pin hole may be formed in a circumferential central portion of the adapter dovetail tenon to pass through the adapter dovetail tenon in the axial direction of the rotor. The second pin hole may be formed between the (n−1)th bucket and the nth bucket to pass through the (n−1)th bucket and the nth bucket in the axial direction of the rotor.

Each of the buckets may include a root including a bucket dovetail mortise to engage with a portion of the unified annular dovetail protrusion; and a blade protruding from the root in a radial direction of the rotor. With respect to the circumferential direction of the rotor, a length of the tangential entry, a length of the adapter dovetail tenon, a length of the root, and a length of the bucket dovetail mortise may be substantially identical lengths.

In accordance with another aspect of the present invention, a steam turbine may include a casing; the above rotatable body, the rotatable body being rotatably provided in the casing; and a nozzle configured to discharge steam toward the rotatable body.

In accordance with yet another aspect of the present invention, there is provided a method of manufacturing a rotatable body including a rotor and n buckets for converting energy of flowing steam into mechanical work, each bucket configured to be coupled to the rotor in a tangential entry manner, the rotor being configured to support each of the n buckets coupled to the rotor and including an adapter for coupling an nth bucket of the n buckets to the rotor, and a rotor wheel having a circumferential surface on which a tangential entry is provided, the adapter filling the tangential entry when the nth bucket is coupled to the rotor. The method may include assembling first to (n−1)th buckets with the rotor wheel by successively inserting the first to (n−1)th buckets through the tangential entry in a circumferential direction of the rotor; assembling the nth bucket with the adapter; assembling the adapter assembled with the nth bucket with the rotor wheel assembled with the first to (n−1)th buckets, by inserting the adapter assembled with the nth bucket into the tangential entry in an axial direction of the rotor; and collectively moving the first to (n−1)th buckets of the rotor wheel-and-bucket assembly and the nth bucket of the adapter-and-bucket assembly, by one half pitch along the circumferential direction of the rotor. The method may further include fixing the collectively moved buckets by inserting a pin into both of a first pin hole formed in the rotor and a second pin hole formed in the corresponding bucket.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a portion of a rotatable body according to a related art;

FIG. 2 is a partially cutaway, front view of a steam turbine including a rotatable body in accordance with an embodiment of the present invention;

FIG. 3 is a flowchart of a method of manufacturing the rotatable body of FIG. 2;

FIGS. 4-8 are views of portions of the rotatable body of FIG. 2 for illustrating steps S2-S6 of FIG. 3, respectively; and FIG. 9 is a perspective view of a portion of the rotatable body of FIG. 2 manufactured by the method of FIG. 3.

DESCRIPTION OF SPECIFIC EMBODIMENTS

Hereinafter, a rotatable body, a method of manufacturing the rotatable body, and a steam turbine including the rotatable body in accordance with the present invention will be described in detail with reference to the accompanying drawings.

Referring to FIG. 3, the steam turbine of the present invention may include a rotatable body 200 in accordance with an embodiment of the present invention; a casing 100 forming the turbine's outer appearance and frame, in which the rotatable body 200 is rotatably installed; and a nozzle (not shown) configured to discharge steam toward the rotatable body 200. The rotatable body 200 may include a rotor 300 provided to be rotatable, and a number (n) of buckets 400 coupled to the rotor 300 and configured to convert the energy of flowing steam discharged from the nozzle into mechanical work. The n buckets 400, the buckets 400(1) through 400(*n*), may be coupled to the rotor 300 in a so-called tangential entry manner. Each of the n buckets 400 may be formed to be supported by the rotor 300.

The rotor 300 may include a rotor wheel 310 and an adapter 320 coupled to the rotor wheel 310 in order to couple the closer bucket to the rotor 300. With the adapter 320 coupled to the rotor wheel 310, the rotor 300 may take on a disc shape.

As shown in FIGS. 4 and 6, a tangential entry 312 may occupy a position on the circumference of the rotor wheel 310 and may function as a slot to be filled with the adapter 320 and as an access point for the coupling of the buckets 400 to the rotor 300. Thus, the buckets 400 can be individually inserted into the tangential entry 312 in order to be coupled, one by one, to the rotor wheel 310 of the rotor 300.

The rotor wheel 310 may include a rotor dovetail tenon 314, occupying the majority of a circumferential surface of the rotor wheel 310 and protruding axially from the surface, and an axial dovetail mortise 316 formed as a recess to coincide with the position of the tangential entry 312. Thus, the rotor dovetail tenon 314 may extend, in a circumferential direction of the rotor 300, from one side of the tangential entry 312 back around to the other side of the tangential entry 312, leaving a gap in the rotor dovetail tenon 314. The axial dovetail mortise 316 is effectively formed under the tangential entry 312 and may be recessed with respect to a radial direction (inward) of the rotor 300 and may extend in an axial direction (thickness) of the rotor 300.

As described above, the tangential entry 312 is a space functioning as the entrance for the buckets 400 to allow the buckets 400 to be coupled to the rotor 300 in an insertion manner along the circumferential direction of the rotor 300. In order to allow insertion of each bucket 400 into the tangential entry 312, a circumferential length (arc) of the tangential entry 312 may be equal to or substantially equal to the width of one bucket 400 in the circumferential direction of the rotor 300. Hereinafter, the terms "circumferential direction," "axial direction," and "radial direction" will respectively refer to the corresponding directions of the rotor 300.

Although the tangential entry 312 may have a size enabling multiple buckets 400 to simultaneously enter the tangential entry 312, it may be preferable that, as shown in the present embodiment, the tangential entry 312 have a size enabling only one bucket 400 at a time to enter the tangential entry 312, so as to minimize the size of the gap in the rotor dovetail tenon 314 that is formed by the tangential entry 312.

The rotor dovetail tenon 314, along with an adapter dovetail tenon 324 to be described below, may form a unified annular dovetail tenon R (FIG. 6) protruding axially from the circumferential surface of the rotor 300. The unified annular dovetail tenon R operates in conjunction with a bucket dovetail mortise 412 to be described below. Here, when the buckets 400 move in the circumferential direction, along the circumferential surface of the rotor 300, the unified annular dovetail tenon R and the bucket dovetail mortise 412 may function to guide movement of the buckets 400 in the circumferential direction. In addition, the unified annular dovetail tenon R and the bucket dovetail mortise 412 may function to support the buckets 400 and to prevent the buckets 400 from axially or radially separating from the rotor 300. The shape of a cross-section of the rotor dovetail tenon 314, taken perpendicularly to the circumferential direction, may be constant all along the circumference of the rotor 300, thus allowing each bucket 400 inserted through the tangential entry 312 to be moved in the circumferential direction. In order to prevent each bucket 400 coupled to the rotor dovetail tenon 314 from being separated from the rotor dovetail tenon 314 in the radial direction, the rotor dovetail tenon 314 may include at least one projection protruding in the axial direction and at least one depression recessed in the axial direction.

The axial dovetail mortise 316 operates in conjunction with an axial dovetail tenon 326 to be described below. The axial dovetail mortise 316 and the axial dovetail tenon 326 may function to allow the adapter 320 to be moved in the axial direction (insertion, extraction) and to be coupled to the rotor wheel 310. In addition, the axial dovetail mortise 316 and the axial dovetail tenon 326 may function to support the adapter 320 and to prevent the adapter 320 from being radially separated from the rotor wheel 310 and from moving with respect to the circumferential direction. The shape of a cross-section of the axial dovetail mortise 316, taken perpendicularly to the axial direction, may be constant along the axial direction, thus allowing an axial dovetail tenon 326 (to be described later) of the adapter 320 to be inserted into the axial dovetail mortise 316 and the adapter 320 to be moved in the axial direction. In order to prevent the adapter 320 coupled to the axial dovetail mortise 316 from being separated from the axial dovetail mortise 316 in the radial direction, the axial dovetail mortise 316 may include at least one projection protruding in the circumferential direction and at least one depression recessed in the circumferential direction.

The adapter 320 may include the adapter dovetail tenon 324 and the axial dovetail tenon 326, which, as described above, engages with the axial dovetail mortise 316. The adapter dovetail tenon 324 protrudes axially from a surface S of the adapter 320 (FIG. 5) and fills the gap in the rotor dovetail tenon 314. Moreover, together with a corresponding bucket 400, the adapter dovetail tenon 324 also fills the tangential entry 312. In other words, the adapter dovetail tenon 324 may have a circumferential length equivalent to that of the tangential entry 312.

The surface S of the adapter 320 is consistent with the circumferential surface of the rotor wheel 310 on which the rotor dovetail tenon 314 is formed. Combined with the surface S, the circumferential surface of the rotor wheel 310 coincides with the circumferential surface of the rotor wheel 310 on which the unified annular dovetail tenon R is formed.

As described above, the adapter dovetail tenon 324 may complete the unified annular dovetail tenon R along with the rotor dovetail tenon 314. That is, as in the case of the rotor dovetail tenon 314, the shape of a cross-section of the adapter dovetail tenon 324, taken perpendicularly to the circumferential direction, may be constant in the circumferential direction, thus allowing the buckets 400 to be moved in the circumferential direction. Further, also as in the case of the rotor dovetail tenon 314, in order to prevent the buckets 400 coupled to the adapter dovetail tenon 324 from being separated from the adapter dovetail tenon 324 in the radial direction, the adapter dovetail tenon 324 may include at least one projection protruding in the axial direction and at least one depression recessed in the axial direction. In other words, the adapter dovetail tenon 324 may include projections and recesses in the same manner as in the case of the rotor dovetail tenon 314, thus supporting at least one bucket 400 of the n buckets 400.

As shown in the present embodiment, and exemplified in FIG. 7, in the case where the n buckets 400 are collectively moved by one half pitch, the adapter dovetail tenon 324 may support a portion of an (n−1)th bucket 400(*n*−1) and a portion of an nth bucket 400*n*, i.e., the closer bucket. Before the n buckets 400 are collectively moved, the adapter dovetail tenon 324 may support one bucket 400 of the n buckets 400, namely, the nth bucket 400*n*.

To allow the axial dovetail tenon 326 to engage with the axial dovetail mortise 316, the shape of a cross-section of the axial dovetail tenon 326, taken perpendicularly to the axial direction, may be constant in the axial direction, and the axial dovetail tenon 326 may include at least one projection protruding in the circumferential direction and at least one depression recessed in the circumferential direction.

Each of the n buckets 400 may include a root 410 which is coupled to the rotor 300, and a blade 420 which protrudes from the root 410 in the rotational radial direction. The root 410 may include the bucket dovetail mortise 412 and a platform 414 (FIG. 4) encasing the bucket dovetail mortise 412. The bucket dovetail mortise 412 engages with a portion of the unified annular dovetail tenon R, and the platform 414 defines the outer appearance of the root 410. The bucket dovetail mortise 412 may have a circumferential length equivalent to that of the root 410.

To allow the bucket dovetail mortise 412 to engage with the unified annular dovetail tenon R, the shape of a cross-section of the bucket dovetail mortise 412, taken perpendicularly to the circumferential direction, may be constant in the circumferential direction, and the bucket dovetail mortise 412 may include at least one projection protruding in the axial direction and at least one depression recessed in the axial direction.

The rotatable body 200 in accordance with the present embodiment may be manufactured by the following method, to prevent axial movement of the adapter 320 and a bucket 400 supported on the adapter 320 and their becoming separated from the rotor wheel 310 and buckets 400 supported on the rotor wheel 310.

Referring to FIG. 3, the rotatable body 200 may be manufactured by a method including a first step S1 of providing the rotor 300 and the n buckets 400; a second step S2 of assembling first to (n−1)th buckets 400(1) to 400(*n*−1) with the rotor wheel 310; a third step S3 of assembling the nth bucket 400*n* with the adapter 320; a fourth step S4 of assembling the adapter 320 with the rotor wheel 310; and a fifth step S5 of moving the n buckets 400 in the circumferential direction.

In detail, a bucket 400 to be finally assembled among the n buckets 400 is referred to as the nth bucket 400*n*, a bucket 400 adjacent to the nth bucket 400*n* is referred to as the first bucket 400(1), and the other buckets 400 are respectively referred to as second to (n−1)th buckets 400(2) to 400(*n*−1) in a sequence from the first bucket 400(1) to the nth bucket 400*n* along the circumferential direction. At the steps S1 and S2, the first to (n−1)th buckets 400(1) to 400(*n*−1) may be successively assembled with the rotor wheel 310 by inserting the first to (n−1)th buckets 400(1) to 400(*n*−1) in the circumferential direction by way of the tangential entry 312, the rotor dovetail tenon 314, and the bucket dovetail mortise 412.

Thereafter, at the step S3, the nth bucket 400*n* may be assembled with the adapter 320 using the bucket dovetail mortise 412 of the nth bucket 400*n* and the adapter dovetail tenon 324 of the adapter 320.

Subsequently, at the step S4, the adapter 320 assembled with the nth bucket 400*n* may be assembled, by inserting the adapter 320 into the tangential entry 312 in the axial direction, with the rotor wheel 310 assembled with the first to (n−1)th buckets 400(1) to 400(*n*−1). In other words, when the axial dovetail tenon 326 is inserted into the axial dovetail mortise 316, the adapter dovetail tenon 324 is inserted into the tangential entry 312, thus forming the unified annular dovetail tenon R along with the rotor dovetail tenon 314. In addition, the nth bucket 400*n* that has engaged with the adapter dovetail tenon 324 is interposed between the first bucket 400(1) and the (n−1)th bucket 400(*n*−1).

Thereafter, at the step S5, the first to (n−1)th buckets 400(1) to 400(*n*−1) assembled with the rotor wheel 310 and the nth bucket 400*n* assembled with the adapter 320 may be collectively moved to a predetermined position along the circumferential direction.

Here, the predetermined position may be a position at which the root 410 of a specific bucket 400 of the n buckets 400 overlaps one junction between the rotor dovetail tenon 314 and the adapter dovetail tenon 324 and at which the root 410 of a bucket 400 adjacent to the specific bucket 400 overlaps the other junction between the rotor dovetail tenon 314 and the adapter dovetail tenon 324, with respect to the axial and radial directions.

In other words, if the circumferential length of the root 410 corresponds to one pitch, as described in the present embodiment, the predetermined position may be a position at which, by collectively moving the first to (n−1)th buckets 400(1) to 400(*n*−1) assembled with the rotor wheel 310 and the nth bucket 400*n* assembled with the adapter 320 by one half pitch in the circumferential direction, a central portion of the (n−1)th bucket 400(*n*−1) axially and radially overlaps one junction between the rotor dovetail tenon 314 and the adapter dovetail tenon 324, while a central portion of the nth bucket 400*n* axially and radially overlaps the other junction between the rotor dovetail tenon 314 and the adapter dovetail tenon 324.

Although the n buckets 400 are disposed at the predetermined position as the rotatable body 200 are formed through the steps S1 to S5, the n buckets 400 may be undesirably moved in the circumferential direction and become displaced from the predetermined position, for example, because of operation of the steam turbine. That is, the junctions between the rotor dovetail tenon 314 and the adapter dovetail tenon 324 may be respectively aligned with side surfaces of the root 410 of any bucket 400 among the n buckets 400 in the axial and radial directions. Thereby, the adapter 320 and the bucket 400 supported on the adapter 320 may be moved in the axial direction and become separated from the rotor wheel 310 and the other buckets 400 supported on the rotor wheel 310.

Given this, the rotatable body 200 in accordance with the present embodiment may further include a fixing unit for fixing the n buckets 400 at the predetermined position.

In detail, the fixing unit may include a first pin hole H1 formed in the adapter dovetail tenon 324, a second pin hole H2 formed between the root 410 of the (n−1)th bucket 400(*n*−1) and the root 410 of the nth bucket 400*n*, and a pin P inserted into the first pin hole H1 and the second pin hole H2.

The first pin hole H1 may be formed passing through the adapter dovetail tenon 324 along the axial direction in a circumferential central portion of the adapter dovetail tenon 324.

The second pin hole H2 may be formed passing through the root 410 of the (n−1)th bucket 400(*n*−1) and the root 410 of the nth bucket 400*n* along the axial direction between the root 410 of the (n−1)th bucket 400(*n*−1) and the root 410 of the nth bucket 400*n*. That is, a milled groove formed in the (n−1)th bucket 400(*n*−1) and a milled groove formed in the nth bucket 400*n* may form the second pin hole H2.

The pin P may be force-fitted into at least one of the first pin hole H1 and the second pin hole H2 so that separation of the pin P from the first pin hole H1 and the second pin hole H2 in the axial direction can be prevented.

Here, the method of manufacturing the rotatable body 200 in accordance with the present embodiment may further include a sixth step S6 of fixing the n buckets 400 by fitting the pin P into the first pin hole H1 and the second pin hole H2 after the step S5.

In other words, in the rotatable body 200 according to the present embodiment, the first pin hole H1 and the second pin hole H2 may face each other when the n buckets 400 are disposed at the predetermined position at the step S5, and the n buckets 400 may be fixed at the predetermined position by fitting the pin P into the first pin hole H1 and the second pin hole H2 at the step S6.

Hereinafter, the effects of the rotatable body, the method of manufacturing the rotatable body, and the steam turbine including the rotatable body in accordance with the present embodiment will be described.

Steam discharged from the nozzle (not shown) is introduced to the n buckets 400 along the axial direction. The steam introduced to the buckets 400 passes through the buckets 400 while a flow direction thereof is changed by the buckets 400.

Here, impulsive force may be applied to the buckets 400 by the steam. Thereby, the buckets 400 along with the rotor 300 are rotated in the circumferential direction, so that the energy of the steam may be converted into mechanical energy.

In the rotatable body, the method of manufacturing the rotatable body, and the steam turbine including the rotatable body in accordance with the present embodiment, the n buckets 400 are coupled to the rotor 300 in a tangential entry manner, wherein all of the n buckets 400 are configured to be supported on the rotor 300, whereby the n buckets 400 can be stably coupled to the rotor 300. That is, the adapter dovetail tenon 324 of the adapter 320 fills the gap in the rotor dovetail tenon 314 of the rotor wheel 310 formed by the tangential entry 312. Thereby, the unified annular dovetail tenon R that is a complete, annular dovetail tenon may be formed around the entire circumferential surface of the rotor 300. Hence, not only the first to (n−1)th buckets 400(1) to 400(*n*−1) but also the nth bucket 400*n* that is a closer bucket 400 can be supported on the unified annular dovetail tenon R. As a result, a significant amount of load may be prevented from being applied to a specific portion of the dovetail, so that the dovetail may be prevented from being damaged by the load concentration, and a problem of the separation of a bucket 400 from the rotor 300 due to the damage to the dovetail may be fundamentally prevented.

As the n buckets 400 are collectively moved in the circumferential direction and disposed at the predetermined position at the steps S3 to S5, the adapter 320 and the buckets 400 are prevented from being separated from the rotor 300 in the axial direction or radial direction. Thereby, the n buckets 400 may be more stably coupled to the rotor 300.

Furthermore, as the n buckets 400 are fixed at the predetermined position at the step S6, the n buckets 400 may be prevented from being moved from the predetermined position. Hence, not only may the n buckets 400 be more stably coupled to the rotor 300, but a problem of reduction in efficiency attributable to a phenomenon in which during the operation of the steam turbine the energy of steam is not completely converted into mechanical work due to rotation of the n buckets 400 relative to the rotor 300 along the circumferential direction may also be fundamentally prevented.

On the one hand, in the present embodiment, the axial dovetail mortise 316 and the axial dovetail tenon 326 are provided, and the adapter 320 is removably coupled to the rotor wheel 310 by moving the adapter 320 in the axial direction. Thus, undesirable separation of the adapter 320 from the rotor 300 in the circumferential direction or radial direction can be prevented. However, the present invention is not limited to this embodiment. Although not shown, there may be neither the axial dovetail mortise 316 nor the axial dovetail tenon 326. In this case, the effects of supporting the n buckets 400 on the rotor wheel 310 and the adapter 320 may be almost the same as that of the present embodiment. However, in this case, because the adapter 320 may be removably coupled to the rotor wheel 310 by moving the adapter 320 not only in the axial direction but also in the radial direction, the assembly or disassembly of the adapter 320 and the rotor wheel 310 may be facilitated. On the other hand, in this case, the (n−1)th bucket 400(*n*−1) and the nth bucket 400*n* among the n buckets 400 disposed at the predetermined position may prevent the adapter 320 from becoming separated from the rotor 300 in the axial direction or radial direction. Alternatively, the adapter 320 may be coupled to the rotor wheel 310 in a force-fitting manner to prevent a separation of the adapter 320 from the rotor 300 in the axial direction or radial direction. However, in order to secure the stable coupling between the adapter 320 and the rotor wheel 310 and prevent excessive residual stress from being generated, it may be preferable that the axial dovetail mortise 316 and the axial dovetail tenon 326 be present, as described in the present embodiment.

Furthermore, although the present embodiment is provided with the adapter 320, the adapter 320 may be omitted. In detail, although not shown, the n buckets 400 may be disposed at the predetermined position in such a way that, after the first to (n−1)th buckets 400(1) to 400(*n*−1) are assembled with the rotor wheel 310, the nth bucket 400*n* is inserted into the tangential entry 312, and the n buckets 400 are collectively moved in the circumferential direction. In this case, the effects of supporting all of the n buckets 400 on the rotor 300 may be similar to that of the present embodiment. That is, with respect to the axial and radial directions, portions of a specific bucket 400 (e.g., the (n−1)th bucket 400(*n*−1)) of the n buckets 400 and a bucket 400 (e.g., the nth bucket 400*n*) adjacent to the specific bucket 400 may simultaneously overlap a circumferential length of the tangential entry. Therefore, the specific bucket 400 (e.g., the (n−1)th bucket 400(*n*−1)) may be supported on the rotor dovetail tenon 314 although the portion of the specific bucket 400 that is supported on the rotor dovetail tenon 314 is only a portion of the specific bucket 400. In addition, the adjacent bucket 400 (e.g., the nth bucket 400*n*) may be supported on the rotor dovetail tenon 314 although the portion of the adjacent bucket 400 that is supported on the rotor dovetail tenon 314 is only a portion of the adjacent bucket 400. However, in this case, the rotor 300 may be unbalanced in weight, and excessive stress may be concentrated on a portion of the rotor dovetail tenon 314. Consequently, it may be preferable that the adapter 320 be provided as described in the present embodiment.

On the other hand, in the case of the present embodiment, the n buckets 400 are moved by one half pitch, at the step S5. However, the present invention is not limited to this.

In other words, the predetermined position may be a position to which the first to (n−1)th buckets 400(1) to 400(*n*−1) assembled with the rotor wheel 310 and the nth bucket 400*n* assembled with the adapter 320 are collectively moved along the circumferential direction within a range greater than a zero pitch and less than one half pitch or a range greater than one half pitch and less than one pitch. Thereby, the (n−1)th bucket 400(*n*−1) axially and radially overlaps one junction between the rotor dovetail tenon 314 and the adapter dovetail tenon 324 at a position displaced from the center of the (n−1)th bucket 400(*n*−1), while the nth bucket 400*n* axially and radially overlaps the other junction between the rotor dovetail tenon 314 and the adapter dovetail tenon 324 at a position displaced from the center of the nth bucket 400*n*. In this case, the effect of preventing separation of the adapter 320 and the corresponding bucket 400 from the rotor 300 in the axial direction may be almost the same as that of the present embodiment, although there may be a disadvantage in terms of a stress relief design.

Alternatively, the predetermined position may be a position at which, by collectively moving the first to (n−1)th buckets 400(1) to 400(*n*−1) assembled with the rotor wheel 310 and the nth bucket 400*n* assembled with the adapter 320 by more than one pitch, for example, an (n−2)th bucket 400(*n*−2) axially and radially overlaps one junction between the rotor dovetail tenon 314 and the adapter dovetail tenon 324, while the (n−1)th bucket 400(*n*−1) axially and radially overlaps the other junction between the rotor dovetail tenon 314 and the adapter dovetail tenon 324. In this case, the effect of preventing separation of the adapter 320 and the corresponding bucket 400 from the rotor 300 in the axial direction may be almost the same as that of the present embodiment, although the time and cost needed to move the n buckets 400 may be increased because the distance that the n buckets 400 are moved is greater.

On the one hand, in the case of the present embodiment, the first pin hole H1 is formed in the circumferential central portion of the adapter dovetail tenon 324, and the second pin hole H2 is formed between the root 410 of the (n−1)th bucket 400(*n*−1) and the root 410 of the nth bucket 400*n*. However, the present invention is not limited to this. That is, on the assumption that the n buckets 400 are moved by one half pitch, the first pin hole H1 may be formed in the adapter dovetail tenon 324 at a position displaced from the circumferential center of the adapter dovetail tenon 324, and the second pin hole H2 may be formed in solely in the root 410 of one or the other of the (n−1)th bucket 400(*n*−1) or the nth bucket 400*n*.

Alternatively, even when the first pin hole H1 is formed in the circumferential central portion of the adapter dovetail tenon 324, as in the present embodiment, if the predetermined position is a position to which the n buckets 400 are moved by more than one half pitch, the second pin hole H2 may be formed at a corresponding position facing the first pin hole H1. In this case, the second pin hole H2 may be formed in the root 410 of a specific bucket 400 or between two adjacent buckets 400, e.g., between the first and second buckets 400(1) and 400(2). As a further alternative, the first pin hole H1 may be formed in the rotor dovetail tenon 314, and the second pin hole H2 may be formed in a specific bucket 400 or between two adjacent buckets 400.

However, taking into account the advantage (reduced production time and cost) of moving the n buckets 400 by one half pitch, and the weight balance and the stress relief design for the rotatable body 200, it may be preferable that the first pin hole H1 and the second pin hole H2 be formed in the manner described in the present embodiment.

In accordance with the concept of the embodiment of the present invention, the dovetail tenons and the dovetail mortises may be interchanged. In other words, in lieu of the rotor dovetail tenon 314 and the adapter dovetail tenon 324, a rotor dovetail mortise and an adapter dovetail mortise may be formed on the rotor 300 side, that is, mortises may be respectively formed in the rotor wheel 310 and adapter 320; in lieu of the bucket dovetail mortise 412, a dovetail tenon may be provided on the root 410 of each bucket 400; and to accommodate the adapter 320, an axial dovetail tenon may be provided on the rotor wheel 310 in lieu of the axial dovetail mortise 316, and an axial dovetail mortise may be formed in the adapter 320 in lieu of the axial dovetail tenon 326.

While the present invention has been described with respect to the specific embodiments, it will be apparent to those skilled in the art that various changes and modifications may be made without departing from the spirit and scope of the invention as defined in the following claims.

What is claimed is:

1. A rotatable body comprising:

a rotor having a circumferential surface on which a tangential entry is provided; and n buckets for converting energy of flowing steam into mechanical work, the n buckets including first to (n−1) th buckets and an nth bucket as a closer bucket, each of the first to (n−1)th buckets and the closer bucket configured to be coupled to the rotor in a tangential entry manner, wherein the rotor is configured to support each of the n buckets coupled to the rotor while a portion of a specific bucket of the n buckets and a portion of a bucket adjacent to the specific bucket simultaneously overlap a circumferential length of the tangential entry.

2. The rotatable body according to claim 1, further comprising:

a unified annular dovetail tenon protruding axially from the circumferential surface of the rotor, wherein each of the n buckets includes a bucket dovetail mortise for engaging with the unified annular dovetail tenon in order to couple the bucket to the rotor.

3. The rotatable body according to claim 2, wherein each of the n buckets is configured to be inserted though the tangential entry and then slid in a circumferential direction of the rotor on the unified annular dovetail tenon in order to successively assemble the n buckets with the rotor.

4. The rotatable body according to claim 1, wherein each of the n buckets has a predetermined length in the circumferential direction of the rotor, and wherein the circumferential length of the tangential entry is substantially equal to the predetermined length.

5. The rotatable body according to claim 1, wherein the rotor comprises:

an adapter for coupling an nth bucket of the n buckets to the rotor; and a rotor wheel having the circumferential surface on which the tangential entry is provided, wherein the adapter fills the tangential entry when the nth bucket is coupled to the rotor.

6. The rotatable body according to claim 5, wherein the adapter is configured to be coupled to the rotor wheel by moving the adapter in an axial direction of the rotor.

7. The rotatable body according to claim 5, wherein the rotor wheel includes an axial dovetail mortise, extending in an axial direction of the rotor, configured to receive the adapter at the tangential entry.

8. The rotatable body according to claim 5, wherein the rotor wheel comprises a rotor dovetail tenon extending in a circumferential direction of the rotor from one side of the tangential entry to the other side of the tangential entry, the rotor dovetail tenon having a gap at the tangential entry.

9. The rotatable body according to claim 8, wherein the adapter comprises an adapter dovetail tenon configured to fill the gap in the rotor dovetail tenon when the nth bucket is coupled to the rotor.

10. The rotatable body according to claim 9, wherein, in order to successively assemble the n buckets with the rotor wheel, each of first to (n−1)th buckets of the n buckets is configured to be inserted through the tangential entry and then slid in the circumferential direction of the rotor on the rotor dovetail tenon, an nth bucket of the n buckets is configured to be assembled with the adapter by sliding on the adapter dovetail tenon, and the adapter assembled with the nth bucket is configured to be inserted into the tangential entry in an axial direction of the rotor.

11. The rotatable body according to claim 9, wherein the rotor dovetail tenon and the adapter dovetail tenon form a unified annular dovetail protrusion protruding axially from the circumferential surface of the rotor.

12. The rotatable body according to claim 9, wherein the adapter dovetail tenon is configured to support at least one bucket of the n buckets.

13. The rotatable body according to claim 8, wherein first to (n−1)th buckets are inserted through the tangential entry and then slid in the circumferential direction of the rotor on the rotor dovetail tenon in order to successively assemble the first to (n−1)th buckets with the rotor wheel, wherein an nth bucket is assembled with the adapter and the adapter assembled with the nth bucket is inserted into the tangential entry in an axial direction of the rotor in order to assemble the nth bucket with the rotor wheel, and wherein the first to (n−1)th buckets assembled with the rotor wheel and the nth bucket assembled with the adapter are collectively moved to a predetermined position along the circumferential direction of the rotor, so that the (n−1)th bucket axially and radially overlaps a first junction between the rotor dovetail tenon and the adapter dovetail tenon, and the nth bucket axially and radially overlaps a second junction between the rotor dovetail tenon and the adapter dovetail tenon.

14. The rotatable body according to claim 13, wherein, when a length of a bucket of the n buckets with respect to the circumferential direction of the rotor is one pitch, the predetermined position is a position to which the first to (n−1)th buckets assembled with the rotor wheel and the nth bucket assembled with the adapter are collectively moved by one half pitch along the circumferential direction of the rotor.

15. The rotatable body according to claim 13, further comprising a fixing unit configured to fix the first to nth buckets at the predetermined position.

16. The rotatable body according to claim 13, further comprising:

at least one bucket in which a second pin hole is formed to be aligned with a first pin hole formed in one of the rotor and adapter dovetail tenons when the first to nth buckets are disposed at the predetermined position; and a pin inserted into the first pin hole and the second pin hole to fix the first to nth buckets at the predetermined position.

17. The rotatable body according to claim 16, wherein the first pin hole is formed in a circumferential central portion of the adapter dovetail tenon to pass through the adapter dovetail tenon in the axial direction of the rotor, and wherein the second pin hole is formed between the (n−1)th bucket and the nth bucket to pass through the (n−1)th bucket and the nth bucket in the axial direction of the rotor.

18. A steam turbine comprising:

a casing;

the rotatable body according to claim 1, the rotatable body being rotatably provided in the casing; and a nozzle configured to discharge steam toward the rotatable body.

19. A method of manufacturing a rotatable body comprising a rotor and n buckets for converting energy of flowing steam into mechanical work, each bucket configured to be coupled to the rotor in a tangential entry manner, the rotor being configured to support each of the n buckets coupled to the rotor and including an adapter for coupling an nth bucket of the n buckets to the rotor, and a rotor wheel having a circumferential surface on which a tangential entry is provided, the adapter filling the tangential entry when the nth bucket is coupled to the rotor, the method comprising:

assembling first to (n−1)th buckets with the rotor wheel by successively inserting the first to (n−1)th buckets through the tangential entry in a circumferential direction of the rotor;

assembling the nth bucket with the adapter;

assembling the adapter assembled with the nth bucket with the rotor wheel assembled with the first to (n−1)th buckets, by inserting the adapter assembled with the nth bucket into the tangential entry in an axial direction of the rotor; and collectively moving the first to (n−1)th buckets of the rotor wheel-and-bucket assembly and the nth bucket of the adapter-and-bucket assembly, by one half pitch along the circumferential direction of the rotor.

20. The method according to claim 19, further comprising:

fixing the collectively moved buckets by inserting a pin into both of a first pin hole formed in the rotor and a second pin hole formed in the corresponding bucket.

* * * * *